US010070237B2

(12) United States Patent
Hanna et al.

(10) Patent No.: US 10,070,237 B2
(45) Date of Patent: Sep. 4, 2018

(54) OPTICAL AND CAPACITIVE SENSING OF ELECTROACOUSTIC TRANSDUCERS

(71) Applicant: ANALOG DEVICES, INC., Norwood, MA (US)

(72) Inventors: Christopher M. Hanna, Arlington, MA (US); Miguel A. Chavez, Cambridge, MA (US); Shrenik Deliwala, Andover, MA (US)

(73) Assignee: ANALOG DEVICES, INC., Norwood, MA (US)

( * ) Notice: Subject to any disclaimer, the term of this patent is extended or adjusted under 35 U.S.C. 154(b) by 59 days.

(21) Appl. No.: 15/157,750

(22) Filed: May 18, 2016

(65) Prior Publication Data

US 2016/0345114 A1 Nov. 24, 2016

Related U.S. Application Data

(60) Provisional application No. 62/164,847, filed on May 21, 2015, provisional application No. 62/169,914, filed on Jun. 2, 2015.

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01)

(58) Field of Classification Search
CPC ..... H04R 29/001; H04R 3/007
See application file for complete search history.

(56) References Cited

U.S. PATENT DOCUMENTS 5,430,802 A * 7/1995 Page ..... H04R 3/002 381/59
9,049,523 B2 6/2015 Bose et al.
2012/0261548 A1* 10/2012 Utukuri ..... G01D 5/34 250/206.1

(Continued)

OTHER PUBLICATIONS

Wolfgang Klippel, *Nonlinear Adaptive Controller for Loudspeakers with Current Sensor*, AES E-Library, Audio Engineering Society, May 1, 1999, http://www.aes.org/e-lib/browse.cfm?elib=8316, 19 pages.

(Continued)

*Primary Examiner* — Ping Lee
(74) *Attorney, Agent, or Firm* — Patent Capital Group

(57) ABSTRACT

Speakers do not always operate linearly. Linearity of the speaker can affect the quality of the sound produced by the speaker, i.e., causing distortions in the sound, if the nonlinearites are not accounted for. To determine nonlinearities of the speaker, the speaker is often modeled and measurements are made to estimate the characteristics of the speaker based on the model. By using an angle sensor and a light source, a speaker manager can make a direct measurement of excursion or displacement of the speaker. Moreover, when the angle sensor, the light source, and the light beam are configured appropriately with respect to the moving cone of the speaker, the measurement can be substantially linear with respect to the amount of excursion or displacement. Such measurements are far simpler to use and in some cases more accurate than measurements made by other types of systems.

20 Claims, 12 Drawing Sheets

(56) References Cited

U.S. PATENT DOCUMENTS

| | | | | |
|---|---|---|---|---|
| 2013/0156412 | A1* | 6/2013 | Naito | G03B 5/00 396/55 |
| 2014/0254805 | A1 | 9/2014 | Su et al. | |

OTHER PUBLICATIONS

F. Antonio Medrano, *Optical Position Sensors with Applications in Servo Feedback Subwoofer Control*, Media Arts and Technology Program, University of California, Santa Barbara, Feb. 13, 2009, 44 pages.

Clark J. Radcliffe et al., *Velocity Feedback Compensation of Electromechanical Speakers for Acoustic Applications*, International Federation of Automatic Control, 1996 Triennial World Congress, San Francisco, California, USA, Jun. 30-Jul. 5, 1996, Paper 3a-07-01, 6 pages.

Wolfgang Klippel, *Active Compensation of Transducer Nonlinearities*, AES E-Library, 23rd International Conference: Signal Processing in Audio Recording and Reproduction, May 1, 2003, http://www.aes.org/e-lib/browse.cfm?elib=12335, 19 pages.

* cited by examiner

OPTICAL AND CAPACITIVE SENSING OF ELECTROACOUSTIC TRANSDUCERS

PRIORITY DATA

This patent application is a Non-Provisional patent application of Provisional Patent Application Ser. No. 62/164,847 filed on May 21, 2015 entitled "OPTICAL SENSING OF ELECTROACOUSTIC TRANSDUCERS" and Provisional Patent Application Ser. No. 62/169,914 filed on Jun. 2, 2015 entitled "OPTICAL AND CAPACITIVE SENSING OF ELECTROACOUSTIC TRANSDUCERS". Both Provisional patent applications are incorporated by reference in their entirety.

TECHNICAL FIELD OF THE DISCLOSURE

The present disclosure relates to the field of electronics, in particular to optical and capacitive sensing of electroacoustic transducers.

BACKGROUND

Electroacoustic transducers, more commonly known as speakers, are ubiquitous. Electroacoustic transducers are often found in consumer audio systems, professional audio systems, automobile entertainment systems, computer systems, handheld devices, mobile devices, medical devices, telephone systems, and practically any system that requires generating audio or sound. Audio and sound are used interchangeably in this disclosure.

Speakers can come in many different sizes and types as well. Some speakers are more suitable or specifically designed for generating low frequency sounds, whereas some other speakers are more suitable or specifically designed for generating high frequency sounds. To generate different frequencies of sounds, the physical design of the speaker may vary in form (e.g., size, shape, material, etc.). In some cases, other design limitations (e.g., form factor or size of a handheld device) may limit or impose requirements on the physical design.

More often than not, higher quality speakers (i.e., speakers producing higher quality audio/sound) are more costly to produce. It is not trivial for engineers to create a low cost speaker with high quality sound.

BRIEF DESCRIPTION OF THE DRAWING

To provide a more complete understanding of the present disclosure, and features and advantages thereof, reference is made to the following description, taken in conjunction with the accompanying figures, wherein like reference numerals represent like parts, in which.

DESCRIPTION OF EXAMPLE EMBODIMENTS OF THE DISCLOSURE

Overview

Speakers do not always operate linearly. Linearity of the speaker can affect the quality of the sound produced by the speaker, i.e., causing distortions in the sound, if the nonlinearites are not accounted for. To determine nonlinearities of the speaker, the speaker is often modeled and measurements are made to estimate the characteristics of the speaker based on the model. By using an angle sensor and a light source, a speaker manager can make a direct measurement of excursion or displacement of the speaker. Moreover, when the angle sensor the light source, and the light beam are configured appropriately with respect to the moving cone of the speaker, the measurement can be substantially linear with respect to the amount of excursion or displacement. Such measurements are far simpler to use and in some cases more accurate than measurements made by other types of systems.

Speaker and electroacoustic transducer are used interchangeably herein.

Anatomy of a Speaker

Figure 1:
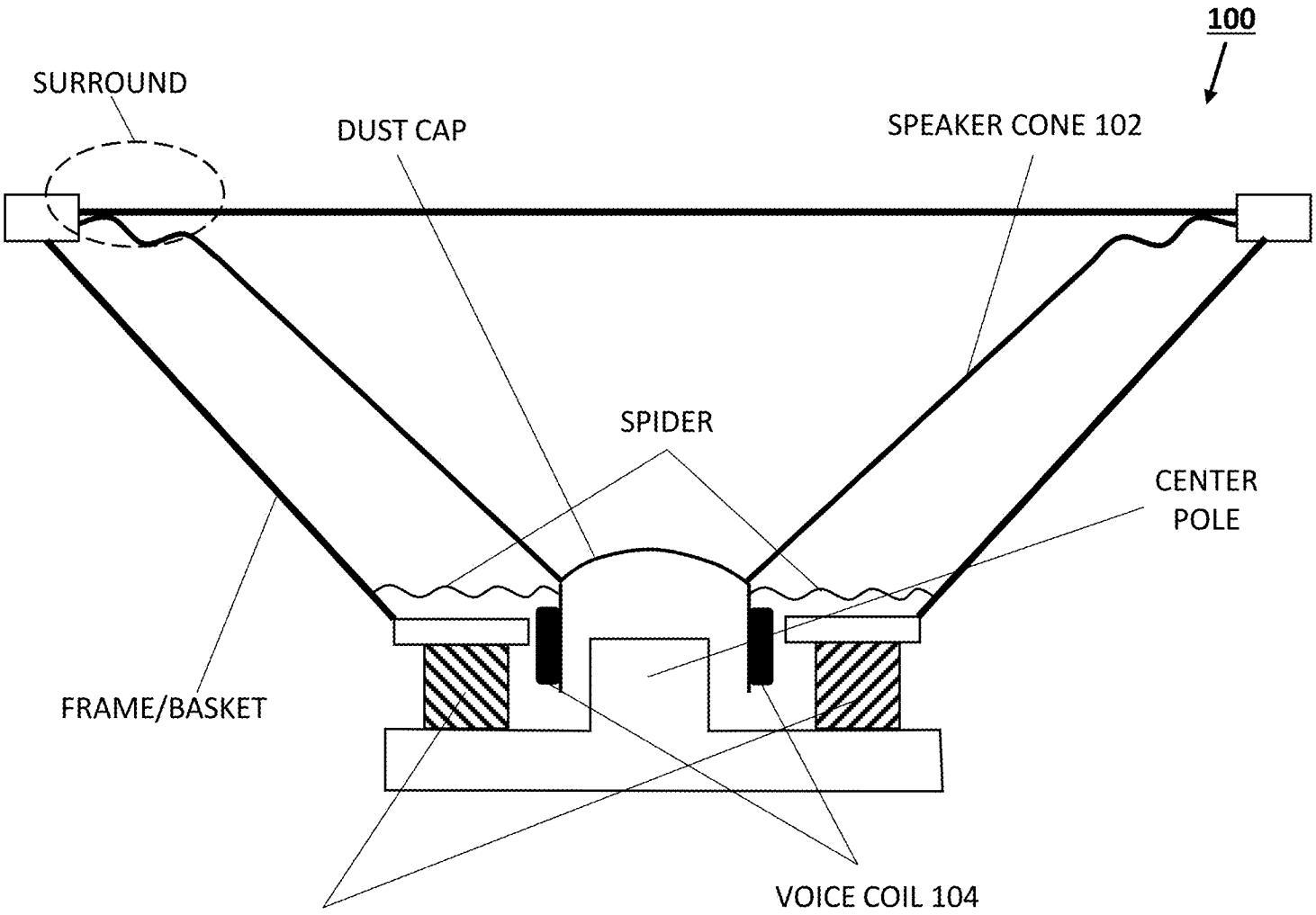
FIG. 1 illustrates an anatomy of a speaker, according to some embodiments of the disclosure.

Designs for a speaker can vary. To illustrate an example, FIG. 1 depicts an anatomy of a speaker or speaker assembly (cross-section view), according to some embodiments of the disclosure. For simplicity, not every part of a speaker is shown. A speaker 100 can include a speaker cone 102. The speaker cone 102 is a diaphragm, whose movement create sound waves. The sound waves form the audio or sound of the speaker. The speaker cone 102 is moved by means of the voice coil 104 and magnet 106. The voice coil 104 is a wire wound into a coil. When current flows through the voice coil 104, the voice coil 104 generates a magnetic field. The magnetic field of the voice coil 104 interacts with the magnet 106 to move the speaker cone 102 up and down. Flexible membranes such as the surround 118 and spider 110 (e.g., rings around the speaker cone 102) keeps the (moving) speaker cone 102 attached to the frame or basket 108 like a suspension system (while the speaker cone 102 moves up and down). The frame/basket 108 forms the enclosure which houses and protects the speaker cone 102. A dust cap 114 is provided at the center of the speaker cone 102 to protect parts of the speaker from dust or other contaminants. Some speaker assemblies include a center pole 106, which forms the base structure for the magnet 106 and frame/basket 108.

Speaker Protection and Linearization

Performance of an electroacoustic transducer (e.g., an audio speaker, loud speaker) can depend on the linearity of the speaker. Linearity ensures that the sound produced by the speaker is as expected or predicted from the signal being used to drive the speaker. Phrased differently, when a speaker is linear, the sound one puts in is what one gets out of the speaker. As a result, a linear speaker is more predictable. For optimal sound, it is important to ensure the electroacoustic transducer is linear or behaves linearly. If parameters or characteristics of the speaker is known, it is possible to adjust or filter the signal driving the speaker to account for nonlinearities of the speaker. The "pre adjustment" can be performed to reduce distortions of the sound generated by the speaker.

Linearity of a speaker also affects other algorithms or filters which are applied to enhance the audio generated by the speaker. More often than not, these algorithms or filters rely on linear theory and would work better (or only) when the speaker is linear. For this reason as well, it is preferable to ensure the speaker operates linearly.

Linearity of the speaker can depend on its physical design, i.e., the electroacoustic transfer function of the speaker or inherent physical properties of how the speaker cone moves to produce sound. Performance such as its linearity of an electroacoustic transducer can also depend on the condition of the speaker. Condition of the speaker can degrade over time from use or over excursion of the speaker. The mechanics or materials can degrade, and in some cases, fail completely (e.g., due to heating). For many speakers, speaker protection mechanisms, e.g., limiters are provided to prevent damage to the speaker.

To provide a linear speaker and speaker protection, one parameter that is often used (e.g., as feedback information) is speaker displacement. Other related parameters include speaker velocity and speaker acceleration. To measure such a parameter is not trivial, since the physical design of a typical electroacoustic transducer is rather limiting, in the sense that the physical space and configuration of the transducer does not leave a lot of room to allow placement of sensors or provide a suitable environment for accurate measurements to be made.

Some optical solutions have been implemented to measure displacement. Some optical solutions, utilizing a simple photo diode, measures intensity of received light to derive displacement of the speaker cone. Such an approach can be greatly affected by the environment (e.g., ambient light), and absolute intensity would likely drift by more than 50% over temperature, lifetime, dust, gain drift, and much more. In many cases, such a design requires specific knowledge of the speaker design (e.g., shape of the dust cap, shape of the speaker cone, etc.). Such shortcomings are also present for linear light detectors (a linear light sensitive device).

Other solutions offer indirect measurement of excursion by sensing the current to the voice coil (as current feedback). These solutions make assumptions about the current and how the speaker cone moves in response to the current. Such assumptions are difficult to make, and when the assumptions are incorrect, the indirect measurements of excursion are inaccurate.

Applying an Optical Angle Sensor to Speaker Linearization and Protection

To directly measure speaker excursion or displacement (and related parameters), an optical solution can be used with an electroacoustic transducer. Specifically, a solution can include analog and/or digital (e.g., low latency) optical sensor circuitry such as an angle sensor for creating a voltage and/or current driven feedback system to control or set electroacoustic transducer parameters (including one or more of: displacement, velocity, acceleration). Electroacoustic transducer parameters can be used for linearization and protection control. Excursion and displacement are used interchangeably herein. Excursion can also be a measure of position, displacement, velocity, and acceleration of the speaker cone.

These electroacoustic transducer parameters or speaker parameters can be used to update a speaker model. Using the speaker model, it is possible to filter the signal driving the speaker to linearize the speaker (or the speaker response). Furthermore, it is also possible to drive the speaker in a manner which would protect the speaker from over excursion based on the speaker parameters.

By linearizing a speaker, cheaper or lower quality speakers can sound much better than their counterparts without such feedback system. In some cases, linearizing the speaker can allow the magnet to be made smaller while maintaining the same or improving the quality of the sound, thereby reducing the cost and weight of the speaker. Such a feature can greatly benefit systems where weight can be costly or highly undesirable (e.g., speaker systems in cars, mobile electronics, laptops, mobile speakers, etc.).

Exemplary Angle Sensor Configurations for Sensing Electroacoustic Transducer Displacement To address one or more shortcomings of other solutions, a speaker excursion measurement system includes a light source to emit light that illuminates a portion of a speaker cone of a speaker, an angle sensor to measure angle information at which light reflected at the portion of the speaker cone arrives at the angle sensor, and a speaker manager to derive displacement of the portion of the speaker cone based on the measured angle information. The speaker manager is described in greater detail with respect to FIG. 7.

The following passages illustrate the configuration of the light source and the angle sensor. The angle sensor is distinct from sensors which senses light intensity or light position, e.g., a photodiode (which measures intensity of light), linear light detectors, linear sensor arrays (e.g., linear array of photosensitive pixels). The angle sensor generates an output or measurement (i.e., angle information) based on the angle at which reflected light beam arrives at the sensor (this output is can be independent from light intensity). For instance, the output can be linearly related to the angle of the reflected light arriving at the sensor. A light source can be provided to emit light, e.g., a light beam or an angled light beam, to allow a measurement to be made. In some cases, the light source emits a light beam directly forward. In some cases, the light source emits an angled light beam tilted at an angle towards a portion of the speaker cone. The light beam or angled light beam can be pointed to a portion of the speaker cone. The light beam or angled light beam is reflected from the portion of the speaker cone. The reflected light beam arrives to an angle sensor positioned to receive the reflected light beam. The angle sensor generates a signal that is based on the angle at which reflected light beam arrives at the sensor.

The speaker manager derives the displacement of the speaker cone based on a right angle geometrical relationship of the displacement and the measured angle information. The distance traveled by the light beam or angled light beam and the reflected light beam can form two sides of a right triangle (or approximate right triangle). The angle measurement generated by the angle sensor can then be used to derive position or displacement of the speaker cone by applying trigonometric relationships.

The angle measurement can be a substantially linear function of position or displacement of the speaker cone, if the angle sensor, light source, and the light beam are configured properly. In many cases, the angle information/measurement can be used with a look up table to directly derive an accurate measurement of position or displacement of the speaker cone. In some cases where the angle measurement is substantially linear with the position or displacement, the angle information/measurement can be used directly for linearizing the speaker or protecting the speaker.

Example Angle Sensor being Used with Straight Light Beam

Figure 2:
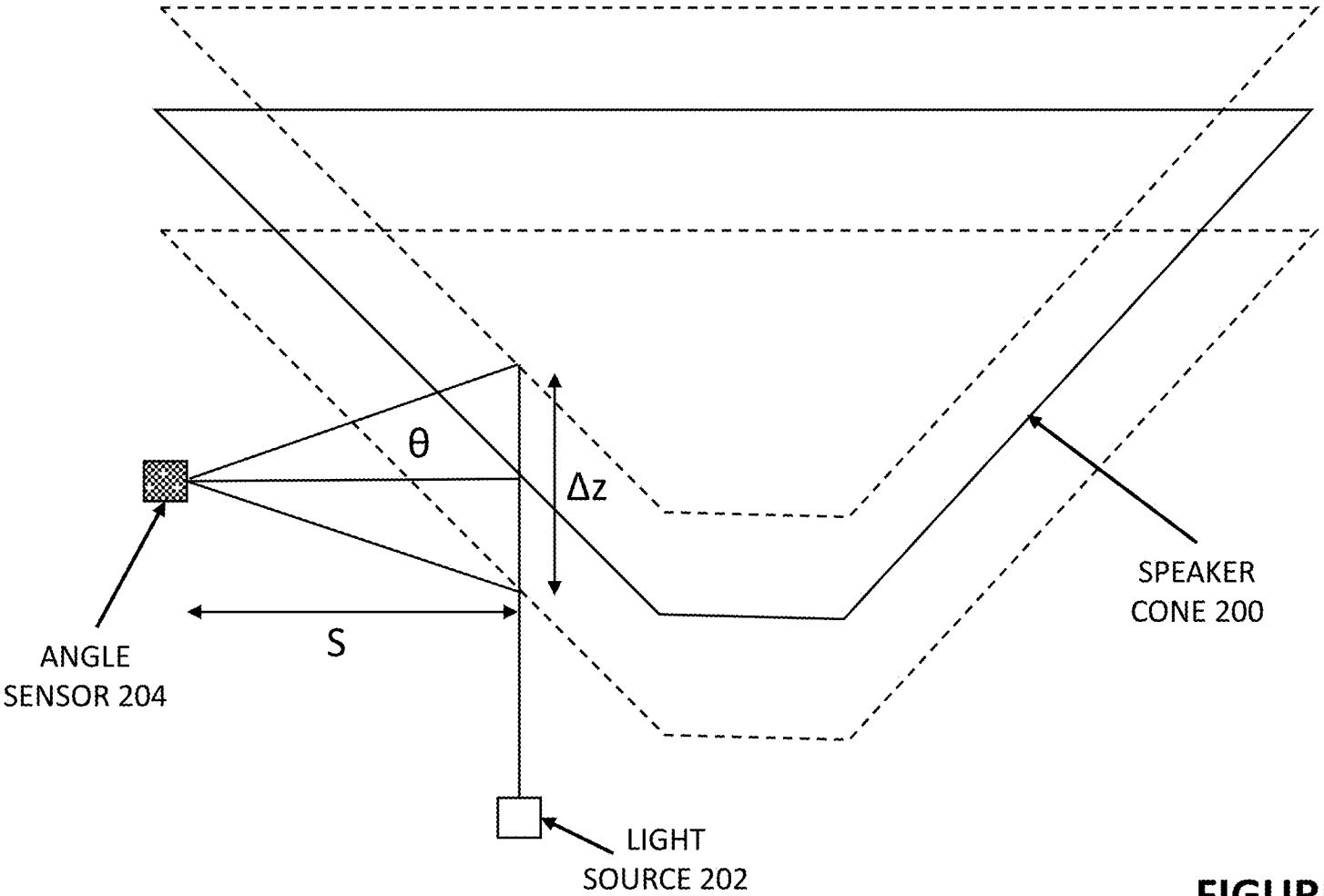
FIG. 2 shows an exemplary embodiment of an optical sensing system comprising an angle sensor, according to some embodiments of the disclosure.

In some embodiments, the speaker manager can derive the displacement of the speaker cone based on tangent of the angle information and a distance between the angle sensor and the portion of the speaker cone. FIG. 2 shows an exemplary embodiment of an optical sensing system comprising a light source 202 and an angle sensor 204 for measuring position or displacement of the speaker cone 200, according to some embodiments of the disclosure. Illustrated by this example, the angle sensor 204 can be used in right angle geometry to measure position or displacement of the speaker cone 200. The change in the angle is a geometrical measurement. The following mathematical relationship can be used: $z=s\tan(\theta)$. z is related to the position of the speaker cone 200, e.g., the position of the portion of the speaker cone 200 reflecting the light beam from the light source ($\Delta z$ for displacement), or distance between the portion of the speaker cone with respect to the light source 202. s is related to the distance between the angle sensor 204 and the speaker cone 200 (the portion of the speaker cone 200 reflecting the light beam from the light source). $\theta$ is the angle information measured by the angle sensor 204.

Figure 3:
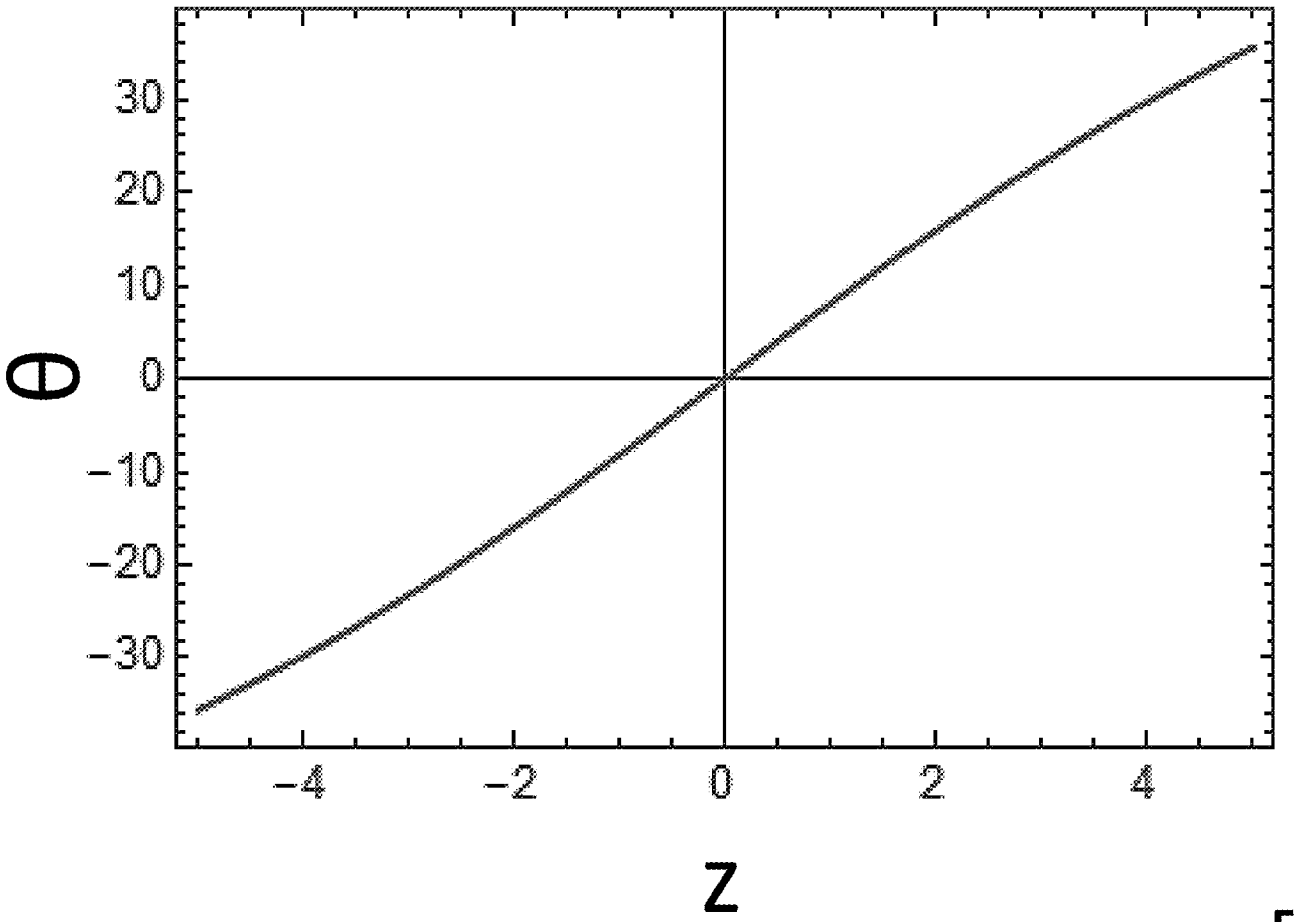
FIG. 3 shows an exemplary plot illustrating the relationship of measured angle and displacement of the speaker cone using the system of FIG. 2, according to some embodiments of the disclosure.

FIG. 3 shows an exemplary plot illustrating the relationship of measured angle and displacement of the speaker cone using the system of FIG. 2, according to some embodiments of the disclosure. It can be seen in FIG. 3 (showing a plot for s=7 mm) that z measurement is a slightly nonlinear function of angle. One possible way to linearize the relationship between $\theta$ and z is by making $s>\Delta z$. Phrased differently, the distance between the angle sensor and the portion of the speaker cone can be made greater than the displacement of the speaker cone.

Example Angle Sensor being Used with Angled Light Beam or Tilted Light Beam

Figure 4:
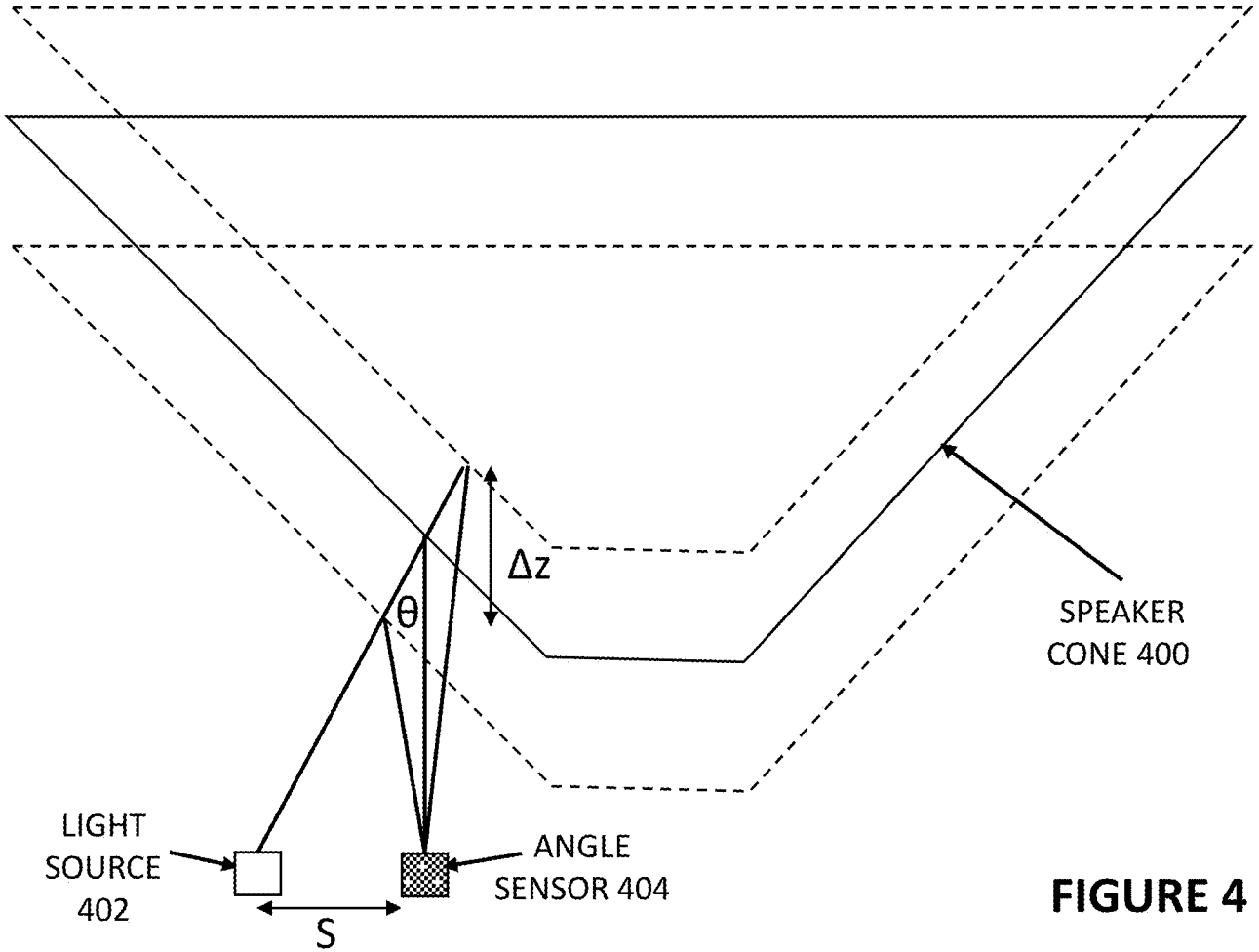
FIG. 4 shows another exemplary embodiment of an optical sensing system comprising an angle sensor, according to some embodiments of the disclosure.

In another instance, the speaker manager can derive the displacement of the speaker cone based on tangent of the angle information and a distance between the angle sensor and the light source. The angle sensor can be used with an angled beam, i.e., the light source emits a tilted or angled beam. FIG. 4 shows another exemplary embodiment of an optical sensing system comprising a light source 402 and an angle sensor 404 for measuring position or displacement of speaker cone 200, according to some embodiments of the disclosure. It can be seen from the figure that the light source 402 tilts the light beam to the right or at an angle rather than straight forward (as seen in FIG. 2). The mathematical relationship based on right angle geometry remains similar to the scheme in FIGS. 2 and 3: $z=s\tan(\theta)$. z is related to the position of the speaker cone 400, e.g., the portion of the speaker cone 400 reflecting the light beam from the light source 402 ($\Delta z$ for displacement), or distance between the angle sensor 404 and the portion of the speaker cone 400. s is related to the distance between the angle sensor 404 and the light source 402. $\theta$ is the angle information measured by the angle sensor 404.

One unique aspect of this configuration shown in FIG. 4 differing from the configuration in FIG. 2 is that the light source 402 can be placed nearby or adjacent to the angle sensor 404. Such configuration can make it easier for packaging but may involve complex angled beam optics for the light source 402 and angle sensor 404. In some embodiments, the speaker manager may calibrate an angle of the angled light beam emitted by the light source 402 using the angle sensor 404.

Figure 5:
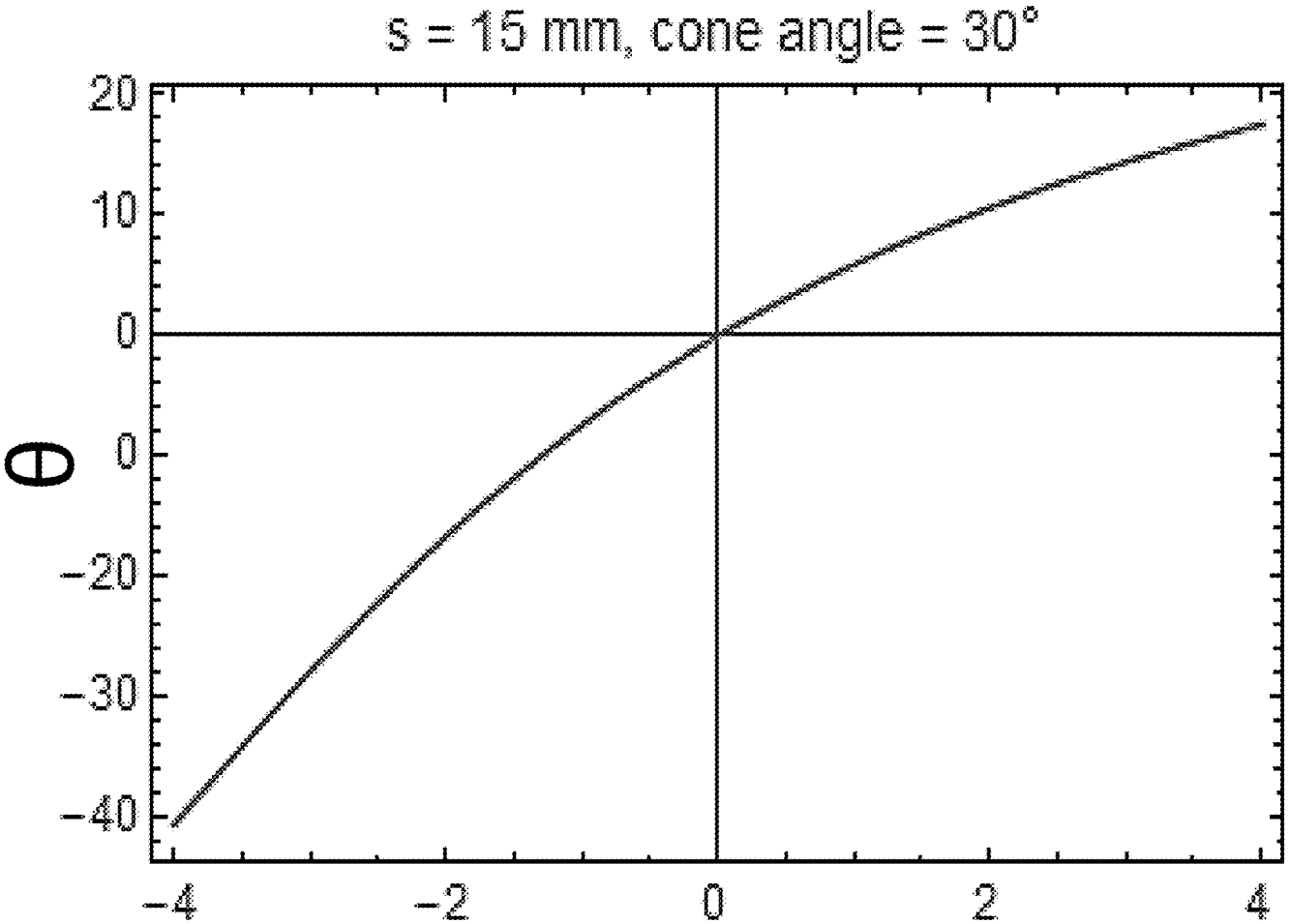
FIG. 5 shows an exemplary plot illustrating the relationship of measured angle and displacement of the speaker cone using the system of FIG. 4, according to some embodiments of the disclosure.

FIG. 5 shows an exemplary plot illustrating the relationship of measured angle and displacement of the speaker cone using the system of FIG. 4, according to some embodiments of the disclosure. It can be seen in FIG. 5 (showing a plot for s=15 mm and cone angle of 30 degrees) that, although system FIG. 4 relies on a similar formula as FIG. 2 to derive z, the curve for $\theta$ is slightly asymmetric with respect to the position z. When the speaker cone 400 is closer to the angle sensor 404, the change in $\theta$ becomes larger. Preferably, the distance to the speaker cone has to be sufficiently large otherwise the angular change in $\theta$ is too large as cone comes closer. In an adaptive system, the angled beam can be tilted with a laser light source (might be more difficult with a light emitting diode). The angle of the tilted/angled beam can be measured and calibrated (e.g., using the optical/angle sensor), e.g., by the speaker manager.

Sensor Placements and Other Variations of the Optical System

While electroacoustic transducers assemblies (e.g., loudspeaker assemblies, speaker assemblies) may limit where to place sensors, the optical solution of this disclosure has a variety of possibilities. Suitable placement of the light source and the optical sensor within a loudspeaker assembly includes one or more of: inside the voice coil, magnetic gap, back plate, and dust cap. Locations can be selected based on factors such as: performance, tolerance to external influences, particles from affecting the sensor, location of excursion measurement, and/or the sensor measurement. The optical solution may include sensing the position of one more of the following: loudspeaker cone, speaker cone near the surround, voice coil, dust cap, surround, and/or suspension ('spider').

In some embodiments, the portion of the speaker cone reflecting the light beam (i.e., the portion of the speaker cone being measured) is adjacent to a surround of the speaker. It may be more preferable to measure displacement at the location of the speaker cone near the surround of the speaker. There is less chance of "breakup" (or loses shape) when compared to other parts of the speaker cone. Higher frequency speakers can experience more "breakup", and therefore the portion being sensed can be selected appropriately to avoid a location where "breakup" happens. But the excursion is less/attenuated at that portion of the speaker cone near the surround of the speaker as opposed to some other locations of the speaker cone. The cone bends or deforms during movement and not each location of the speaker cone would experience the same displacement. In some cases, the excursion is less near the surround than the excursion near the voice coil. However, below the surround, it is usually empty space so you can more easily retrofit speakers to place sensors to measure the displacement of the portion of the speaker cone close to the surround.

In some embodiments, the optical solution may include addition of one or more marks or absolute position markers or indicators on voice coil or other electroacoustic element within electroacoustic transducer or speaker assembly for use with optical sensor control systems.

In some embodiments, the optical solution may include a tilted sensor placement and associated algorithm that derives speaker position, displacement, velocity, and/or acceleration within a speaker assembly for improving speaker linearization and protection of electroacoustic transducers.

In some embodiments, the optical solution may include mounting of optical sensor in voice coil assembly within an electroacoustic transducer.

In some embodiments, the optical solution may include providing optical sensor measurement and temperature control (using the same optical sensor) by utilizing thermochromic materials within electroacoustic transducer element (e.g., applying voice coil coatings which changes color depending on temperature). The optical system can further include thermo-chromic material applied as a coating for a voice coil of the speaker and an optical sensor for sensing color of the thermo-chromic material. The speaker manager can further determine temperature of the voice coil based on an output of the optical sensor, and determine parameters for the speaker based further on the temperature.

The optical solution, preferably, includes sensing position of the speaker cone based on the angle at which the reflected light is received at an angle sensor. In some embodiments, the optical solution may include further include position sensing based on light intensity and/or light position (position of a light spot on a linear photo detector) to improve the overall sensing scheme with more types of measurements. For instance, a plurality of portions of the speaker cone can be sensed to obtain more measurements of speaker excursion. Since a speaker cone experience different amounts of excursion, a speaker excursion measurement system can include multiple sensing schemes measuring displacement of various portions of the speaker cone and/or dust cap.

In another example, a further optical sensor can be included to make measurements of the amount of light present and derive displacement based on the amount of light reflected off the speaker cone or amount of light reflected off the dust cap (dome) varying as a function of distance or displacement of the dust cap. The further optical sensor can be placed on the center pole.

Exemplary Algorithms Leveraging Optical Measurements

Figure 6:
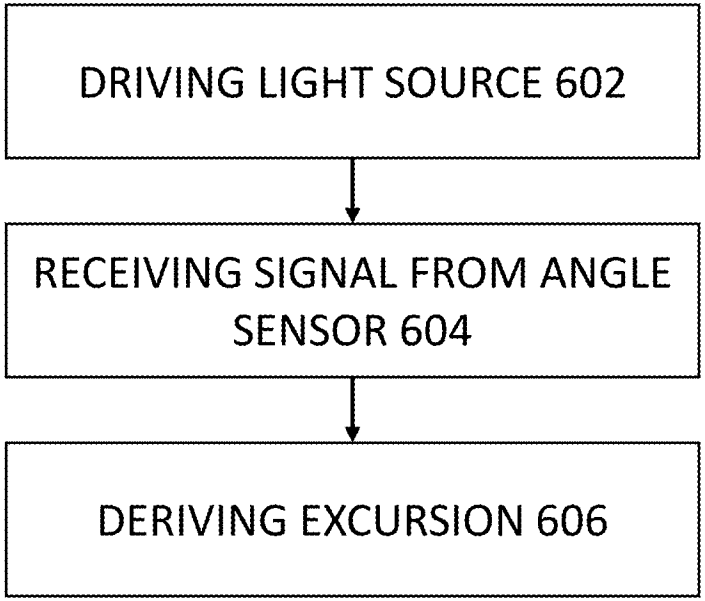
FIG. 6 shows an exemplary method for measuring excursion, according to some embodiments of the disclosure.

FIG. 6 shows an exemplary method for measuring excursion of, e.g., an electroacoustic transducer, according to some embodiments of the disclosure. In task 606, a speaker manager can drive a light source to emit a light beam towards a portion of the electroacoustic transducer. In task 606, a speaker manager may receive a signal from an angle sensor, wherein the signal corresponds to an angle at which reflected light off the portion of the electroacoustic transducer arrives at the angle sensor. Exemplary configurations seen in FIGS. 2 and 4 can be used. In task 608, the speaker manager derives excursion of the electroacoustic transducer based on the signal. Excursion or displacement of the electroacoustic transducer can be derived using the geometrical relationship of an angled light beam, placement of the light source, and placement of the angle sensor.

The optical measurement of the speaker can be used in a variety of algorithms to improve the performance of the speaker. The optical measurement or excursion information can include one or more of the following: position information, displacement information, velocity information, and acceleration information. The signal generated by the angle sensor reflecting the angle information can provide voltage and/or current driven feedback to control or set electroacoustic transducer parameters for linearization and protection control. In one example, an optical method can leverage the measurements to provide feedback control, e.g., electroacoustic transducer protection and control based on one or more of the following measurements or derived measurements: position information, displacement information, velocity information, and acceleration information, etc.

In another example, the method can further include identifying one or more loudspeaker parameters based on the signal. The method can be provided to implement automatic loudspeaker parameter identification based on based on one or more of the following measurements or derived measurements from the angle sensor: position information, velocity information, and acceleration information, etc. Loudspeaker parameter identification can be useful for linearizing the speaker, calibrating the speaker, protecting the speaker, etc.

In another example, the method can further include controlling an adaptive filter based on the signal, wherein the adaptive filter filters an audio signal to the electroacoustic transducer or the audio signal for driving the electroacoustic transducer. The method can be provided to implement adaptive filter control using the signal from the angle sensor, e.g., from which one or more of the following measurements can be derived: position information, displacement information, velocity information, and acceleration information, etc. Such measurements can improve the quality of the adaptive filter and thus the quality of sound generated by the speaker.

In another example, the method can further include executing real-time diagnostics within electroacoustic speaker assembly based on the signal. The optical sensor measurements (e.g., one or more of the following measurements or derived measurements: position information, velocity information, and acceleration information, etc.) can be used for real-time diagnostics within electroacoustic speaker assembly. Diagnostics are useful for checking the condition of the speaker, e.g., determine whether the speaker is experiencing "breakup", whether the speaker is damaged, whether an object is preventing the speaker from moving according to specification, etc. The optical sensor measurements (from which one or more of the following measurements can be derived: position information, displacement information, velocity information, and acceleration information, etc.) can be used for diagnostics and lifetime use or abuse within an electroacoustic speaker assembly.

In another example, the method further includes determining one or more of the following: rub and buss, voice coils misalignment, and DC offset during a lifetime of the electroacoustic transducer. The optical sensor measurements (e.g., from which one or more of the following can be derived position information, displacement information, velocity information, and acceleration information, etc.) can be used to determine rub and buss (voice coil hitting or touching the speaker assembly), voice coils misalignment or DC offset during the lifetime of electroacoustic transducers.

In another example, the method further includes verifying rest position of a voice coil of the electroacoustic transducer based on the signal. The optical sensor measurements (e.g., from which one or more of the following measurements can be derived: position information, displacement information velocity information, and acceleration information, etc.) can be used for verifying rest position of voice coil to calibrate electroacoustic speaker systems. Rest position can be a useful parameter to certain audio filters or linearization of the speaker, especially when the rest position can vary due to manufacturing variations or vary overtime during its lifetime.

Electrical System for Optical Sensing and Speaker Management

Figure 7:
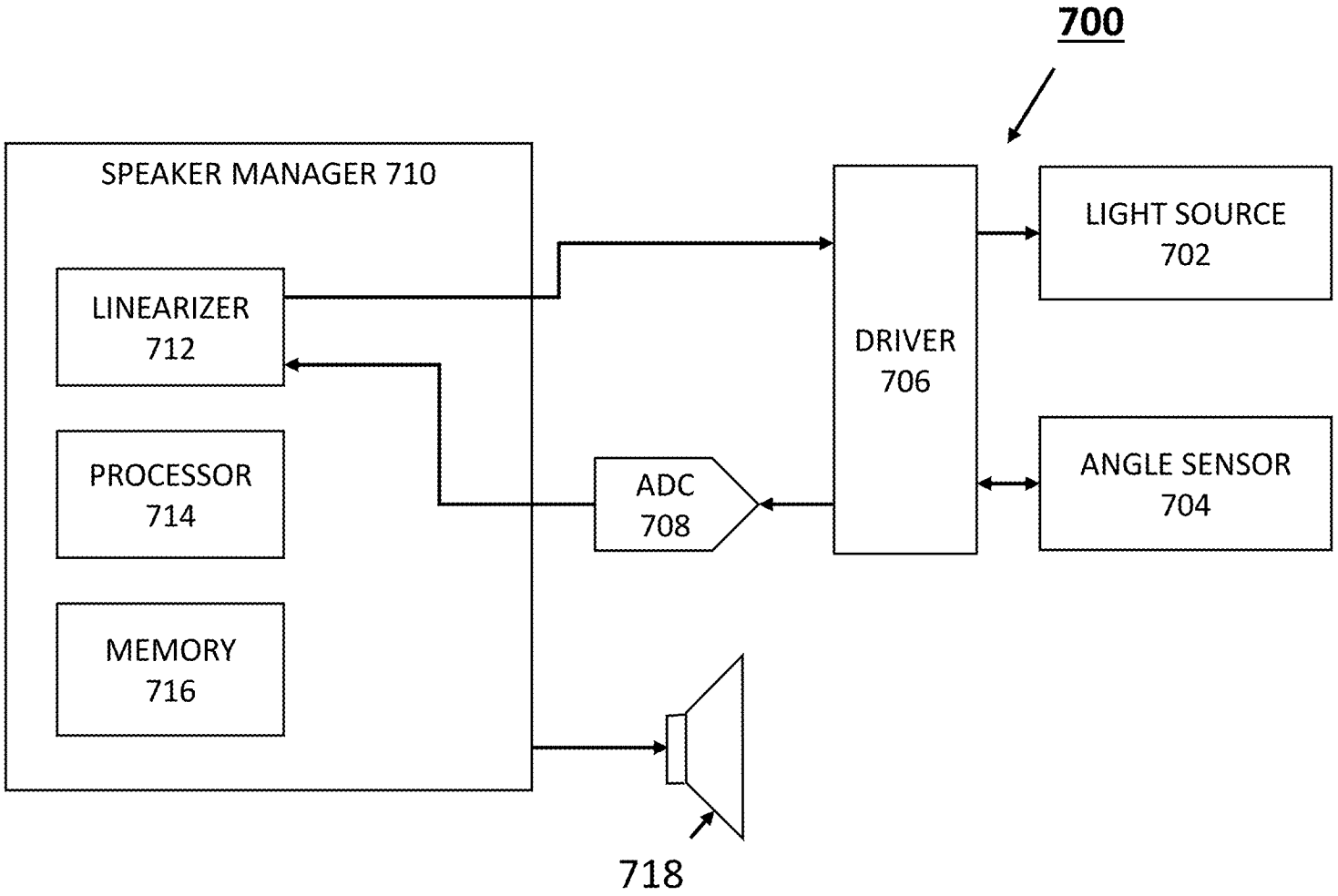
FIG. 7 shows an exemplary speaker management apparatus or system, according to some embodiments of the disclosure.

FIG. 7 shows an exemplary speaker management apparatus/system (e.g. electrical system for optical sensing), according to some embodiments of the disclosure. The apparatus or system 700 for providing optical sensing of the electroacoustic transducer may include one or more light sources 702 for emitting light, one or more optical sensors such as one or more angle sensors 704 for sensing light and/or preferably angle of light arriving at the sensor.

The apparatus or system 700 can further include electrical circuitry such as a driver 706 for driving the light sources and sensors. For instance, the apparatus or system 700 can include means for driving a light source to emit a light beam towards a portion of the electroacoustic transducer and means for driving an angle sensor. In some cases, the electrical circuitry can include an analog front end or means for providing/generating signals to the light source(s) 702 and the optical sensor(s) such as one or more angle sensors 704 and acquiring signals from the optical sensor(s). The apparatus or system 700 can further include means for digitizing a signal from an angle sensor (e.g., an analog to digital converter 708), wherein the signal corresponds to an angle at which reflected light off the portion of the electroacoustic transducer arrives at the angle sensor.

The digitized signal (e.g., from the output of the analog to digital converter 708) can be provided to a speaker manager 710 for further (digital) processing. For instance, the speaker manager 710 can include a linearizer 712 for deriving excursion based on the digital samples from the output of the analog to digital converter 708 and applying filters to an audio signal based on the derived excursion to linearize the speaker 718. The linearizer 712 can also be responsible for controlling driver 706 and receiving digital samples from the output of the analog to digital converter 708. In some embodiments, the linearizer includes means for adjusting speaker parameters (e.g., parameters modeling speaker 718 or parameters for protecting speaker 718) based on the derived excursion as feedback, and means for executing speaker protection mechanism based on the speaker parameters.

In some embodiments, the apparatus or system 700 can include a digital signal processor, or digital signal processing means (e.g., speaker manager 710) for deriving excursion of the electroacoustic transducer based on the signal. The digital signal processing means can include linearizer 712, processor 714, and memory 716 (non-transitory computer readable medium). The memory stores instructions for implementing the functionalities of linearizer 712. When the instructions are executed by the processor 714, the speaker manager 710 carries out the functionalities of the linearizer 712.

In some embodiments, the optical sensors measurements acquired by the driver 706 or other suitable analog front end can be converted by an analog-to-digital converter 708 to digital data samples. The data samples can be stored in a buffer and/or provided to local processing circuitry (e.g., digital signal processor, speaker manager 710). Depending on the system configuration, the digital data samples (and/or derivations thereof) can be transmitted over a communication bus for further processing by processing circuitry (e.g., digital signal processor, speaker manager 710) which is remote from the analog to digital converter 708. For instance, the digital data samples representing excursion of an audio speaker in a car can be transmitted back to a head unit of a car over a communication bus.

Other sensors may be used to make other measurements to supplement the optical measurements, e.g., temperature sensors, capacitive sensors, accelerometers, pressure sensors, humidity sensors, etc. Such sensors can improve the accuracy of estimated speaker parameters.

In some embodiments, the angle sensor is coupled to audio input channel via a resistor in series with the angle sensor, wherein the resistor turns an output current of the angle sensor into voltage. Electrical circuits for making measurements can directly couple the sensor output to the audio input channels by adding a resistor in series with the optical photodiode and turning the photocurrent into the voltage. For bandwidths of less than 10 kHz, this solution can provide better than 60 dB and up to 100 dB measurement.

The speaker manager 710 can include an output signal for driving speaker 718. The output signal may be filtered by linearizer 712 to improve the quality of the speaker based on the excursion measurements. While not shown in the FIGURE, other filters or amplifiers may be included in the signal path driving the speaker 718.

Capacitive Sensing: Coaxial Capacitor

Almost all loudspeakers have a hole through the center of the magnet assembly (at the back of the speaker). This hole extends right through to the cone and is typically covered by the dust cap at the center of the cone. The dust cap, in most cases, serves no purpose other than cosmetic and protection purposes. In some embodiments, an electrode (e.g., a wire, a suitable conductor) is placed within the space through this hole, and a small conductive sleeve can be added with or in place of the dust cap. The electrode and the conductive sleeve form a coaxial capacitor whose capacitance can be proportional to the cone position. Using capacitive sensing, the capacitance can be measured using the electrode and the conductive sleeve to derive cone position (i.e., displacement of the speaker), as the speaker is displaced during operation. The coaxial capacitor can be configured with the speaker such that, as the speaker cone moves, either (1) the electrode is moving and the conductive sleeve is fixed in position, or (2) the conductive sleeve is moving and the electrode is fixed in position. As the two "plates" of the coaxial capacitor is moving relative to each other, the capacitance of the coaxial capacitor can change as the cone position changes. The capacitance changes can be measured to derive cone position and other information related to cone position. Preferably the electrode and the conductive sleeve are arranged such that capacitance change can be observed/detected over the entire range of motion of the speaker cone during operation.

Figure 8:
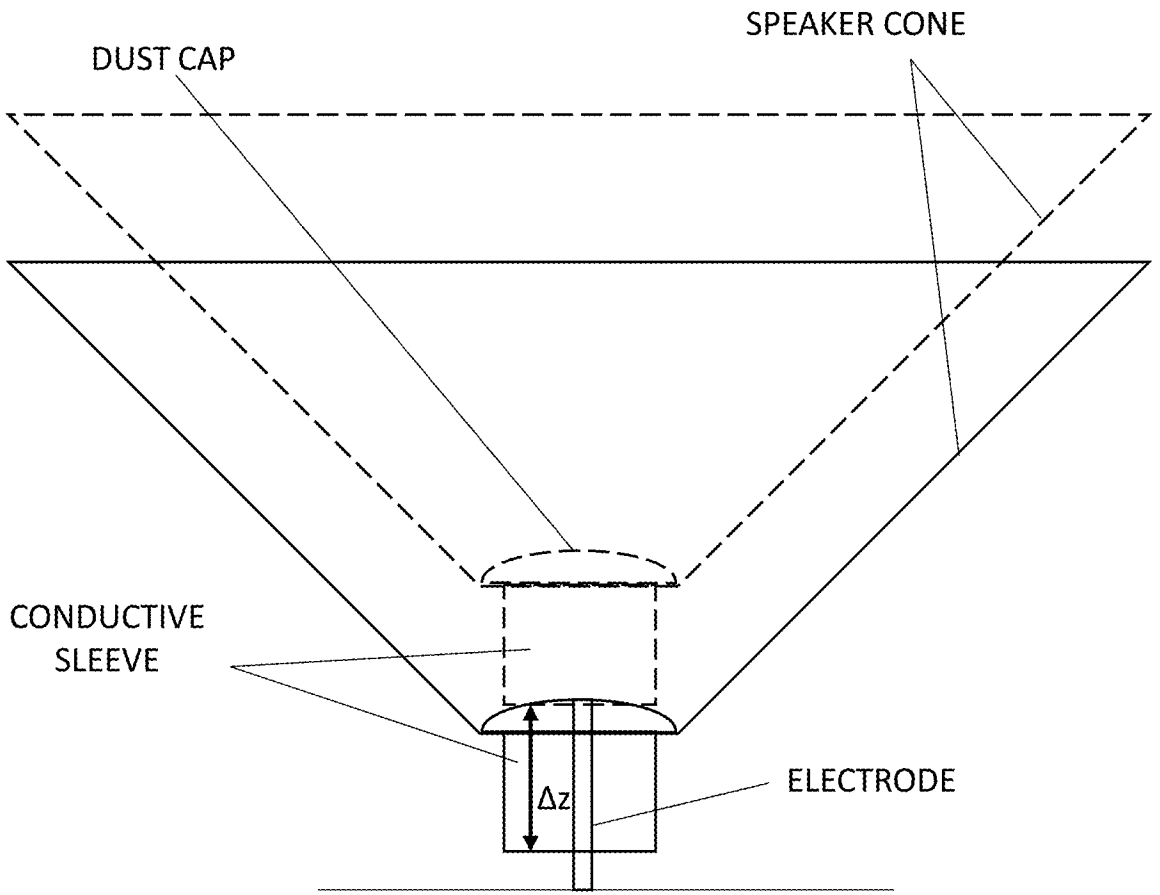
FIG. 8 shows an exemplary embodiment of a capacitive sensing system, according to some embodiments of the disclosure.

FIG. 8 shows an exemplary embodiment of a capacitive sensing system, according to some embodiments of the disclosure. In some embodiments, the coaxial capacitor involves a moving conductive sleeve and a fixed electrode inside the conductive sleeve (or fixed to the speaker assembly). For instance, the conductive sleeve can extend inwards (toward the magnet (back of the speaker) from the front of the speaker (dust cap) and stops before the magnetic circuit. Thus the dust cap can be preserved and the speaker would appear to the user as conventional. The conductive sleeve can be affixed or attached to the cone, and thus would move with the cone as the cone position changes. An electrode can be fixed in position, e.g., affixed/attached to the magnet assembly or back of the speaker.

In some embodiments, the electrode can be alternatively suspended and fixed in front of the speaker, extending towards the back of the speaker and through the conductive sleeve (no dust cap would be provided in this case).

In some embodiments, at least a part of the conductive sleeve could form a bullet shaped conductive plug (these are normally called "phase plugs" and in some cases are used to improve high frequency dispersion of the loudspeaker)—again, making the sleeve "invisible" to a user.

In some embodiments, the use the voice coil itself as the outer ring of the coaxial capacitor (e.g., as the conductive sleeve) if isolating the speaker drive voltage can be isolated from the capacitor.

Figure 9:
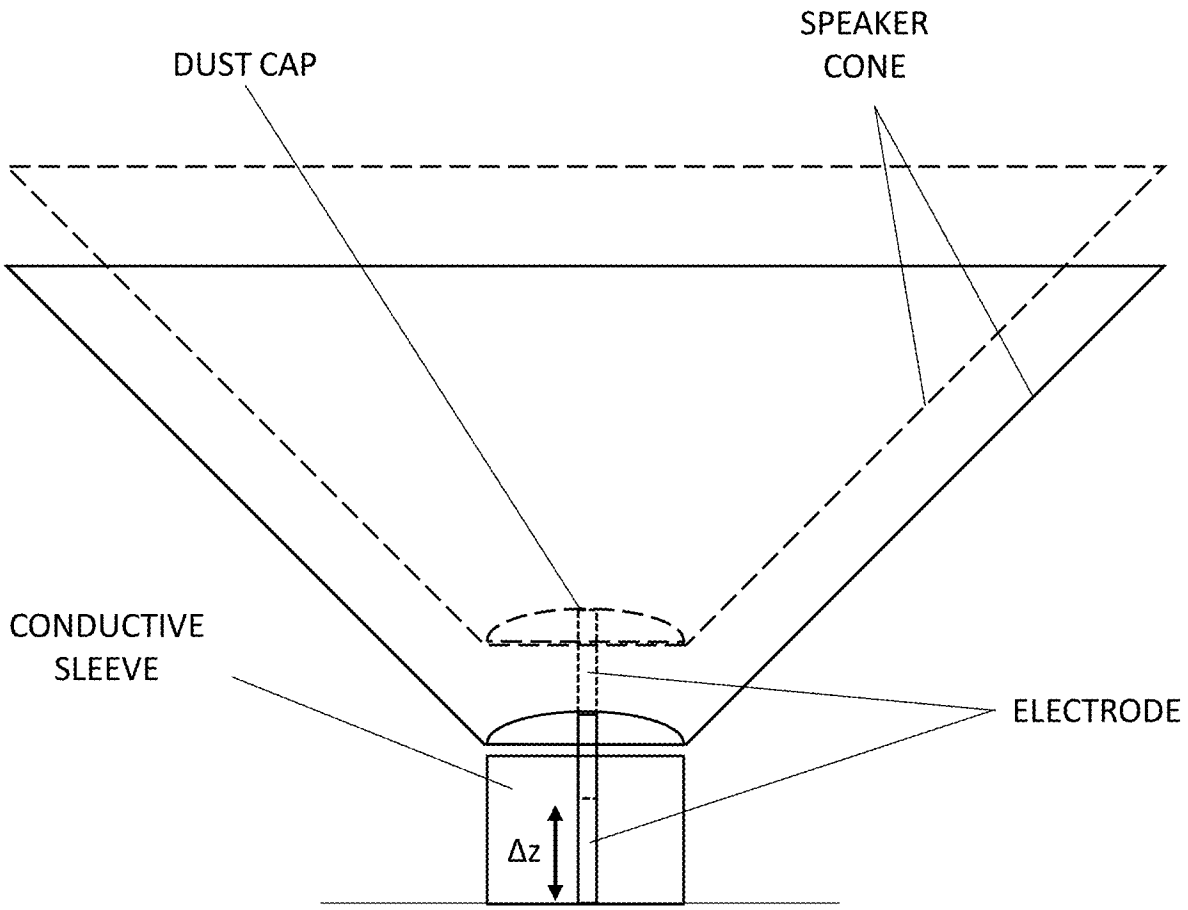
FIG. 9 shows another exemplary embodiment of a capacitive sensing system, according to some embodiments of the disclosure.

FIG. 9 shows another exemplary embodiment of a capacitive sensing system, according to some embodiments of the disclosure. In some embodiments, the coaxial capacitor involves a moving electrode inside a fixed conductive sleeve. The electrode extend from the speaker cone and away from the dust cap and towards the magnet. The electrode can be affixed/attached to the speaker cone, i.e., the dust cap. A fixed (stationary) conductive sleeve can extend outward from the back of the speaker towards the dust cap, thus making up the other half of the coaxial capacitor.

Figure 10:
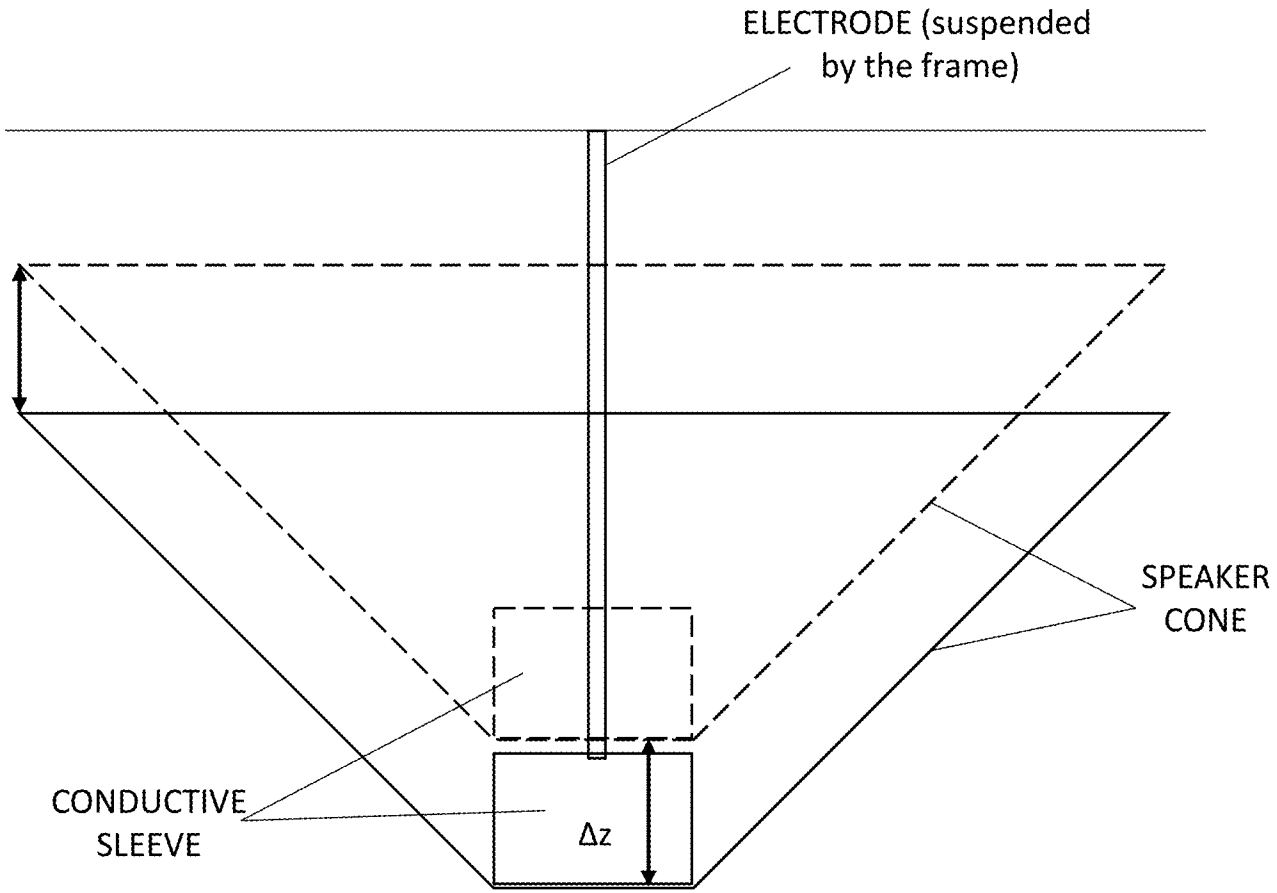
FIG. 10 shows yet another exemplary embodiment of a capacitive sensing system, according to some embodiments of the disclosure.

FIG. 10 shows yet another exemplary embodiment of a capacitive sensing system, according to some embodiments of the disclosure. In some embodiments the coaxial capacitor is not hidden behind the speaker cone, but extends from the front of the cone towards the front of the speaker (e.g., above the dust cap). For instance, as seen in FIG. 10, a conductive sleeve can extend from the front of the cone towards the front of the speaker, while a stationary electrode is suspended (e.g., by a frame of the speaker) from the front of the speaker towards the speaker cone center.

Figure 11:
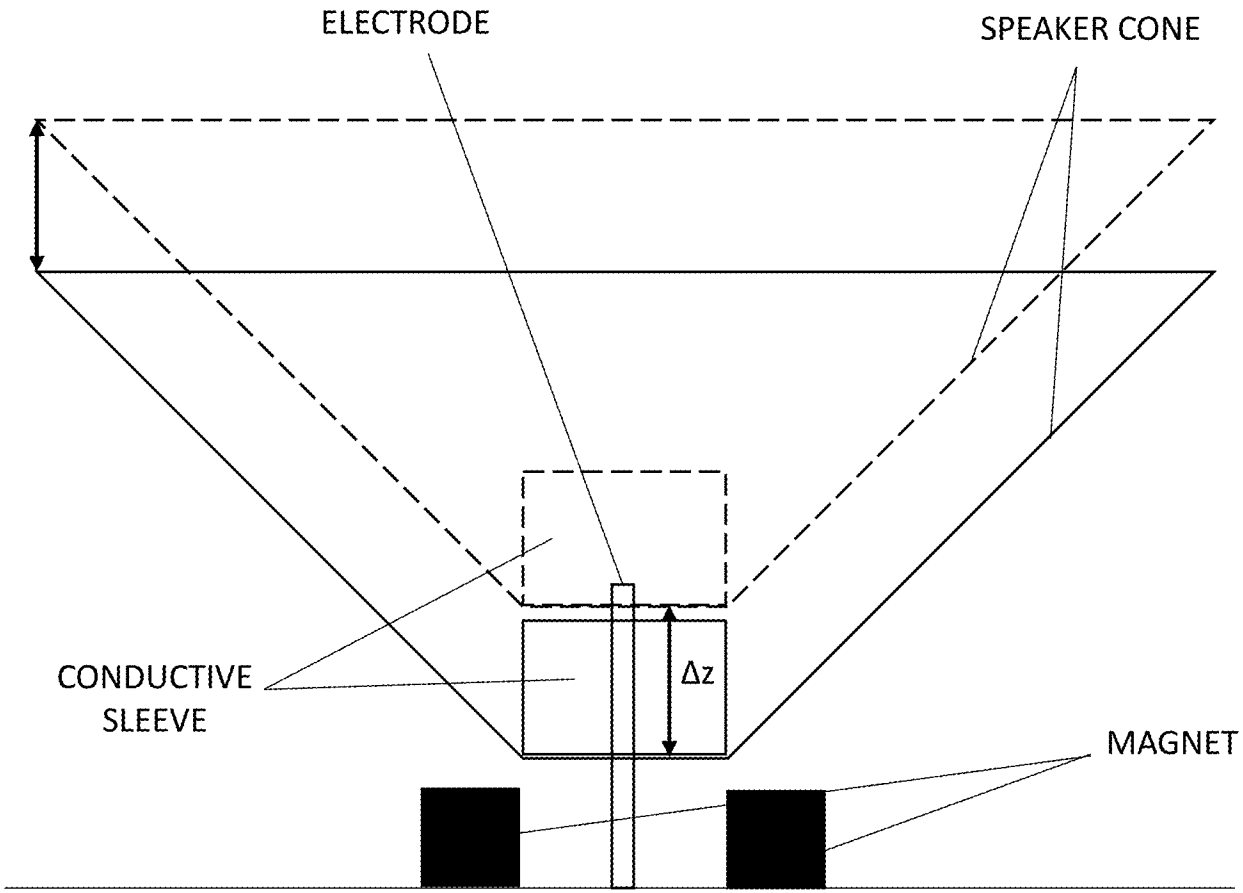
FIG. 11 shows yet another exemplary embodiment of a capacitive sensing system, according to some embodiments of the disclosure.

FIG. 11 shows yet another exemplary embodiment of a capacitive sensing system, according to some embodiments of the disclosure. In some cases, the stationary electrode can be suspended from the back of the speaker, going through the center of the magnet and extending through at least part of the conductive sleeve toward the front of the speaker.

Broadly speaking, arranging the capacitive probe in a coaxial manner has a number of advantages. Chief among the advantages is that variation in X/Y position of the electrode within the sleeve results in no change in capacitance. When used in a loudspeaker (often with vibrations present during operation), it might be a difficult environment to keep an electrode well positioned. Therefore, the tolerance in variation in X/Y position ensures the capacitive sensing reading is still accurate.

Capacitive Sensing: Forming a Capacitor Using the Cone and Frame

Figure 12:
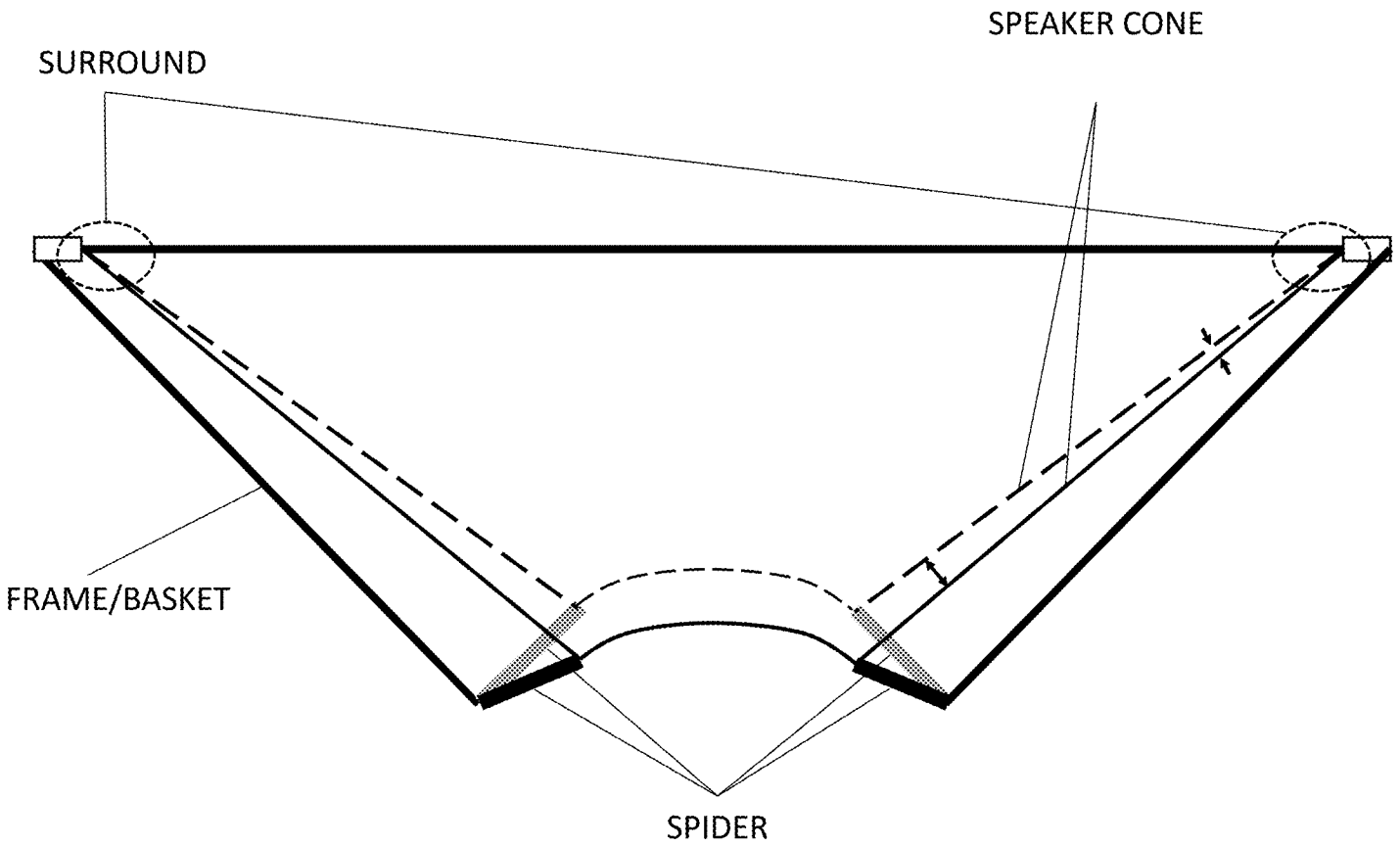
FIG. 12 shows yet another exemplary embodiment of a capacitive sensing system, according to some embodiments of the disclosure.

Instead of using a coaxial capacitor, elements of the speaker can also form as the two plates of a capacitor. FIG. 12 shows yet another exemplary embodiment of a capacitive sensing system, according to some embodiments of the disclosure. For example, the moving speaker cone (e.g., can be made of aluminum or magnesium) can form as one plate of a capacitor and use the basket/frame (e.g., can be conductive) as the other plate of the capacitor. The basket and the cone can be electrically isolated from each other via the surround (which connects the outside perimeter of the cone to the basket at the front of the speaker and the spider (at the apex of the cone) which are both typically made of non-conductive materials like rubber or cloth. Generally speaking the basket is stationary, so as the speaker cone moves, the distance between the cone and the basket changes. The change in distance between the two plates can be measured as change in capacitance. Capacitance measurements using the two plates (i.e., the cone and the frame/basket) can be used to deduce cone position and information related to cone position.

Electrical System for Capacitive Sensing

The electrical system for providing capacitive sensing of the electroacoustic transducer may include one or more electrodes/conductors for generating an electric field and/or sensing changes or an amount of charge present on the electrodes/conductors, and electrical circuitry for driving the electrodes. The electrical circuitry can include an analog front end for providing/generating signals to the electrode(s) and acquiring signals from the electrode(s).

The electrical system can operate in a single-ended mode where a capacitive measurement is made by sensing the change in capacitance between an electrode and another material (conductive, somewhat non-conductive, or non-conductive), whose distance between each other may change. The electrical system can also operate in a mode where a capacitive measurement is made by sensing the change in capacitance between two electrodes/conductors forming the plates of a capacitor.

In some embodiments, the capacitive sensors measurements acquired by the analog front end can be converted by an analog-to-digital converter to digital data samples (e.g., a CDC=capacitance to digital converter). The data samples can be stored in a buffer and/or provided to local processing circuitry (e.g., digital signal processor). Depending on the system configuration, the digital data samples (and/or derivations thereof) can be transmitted over a communication bus for further processing by circuitry which is remote from the capacitance to digital converter. For instance, the data samples representing excursion of an audio speaker in a car can be transmitted back to a head unit of a car over a communication bus.

Other sensors may be used to make other measurements to supplement the capacitive measurements, e.g., temperature sensors, optical sensors, accelerometers, pressure sensors, humidity sensors, etc.

Variations and Implementations

In the discussions of the embodiments above, the capacitors, clocks, DFFs, dividers, inductors, resistors, amplifiers, switches, digital core, transistors, and/or other components can readily be replaced, substituted, or otherwise modified in order to accommodate particular circuitry needs. Moreover, it should be noted that the use of complementary electronic devices, hardware, software, etc. offer an equally viable option for implementing the teachings of the present disclosure.

Parts of various apparatuses for making optical measurements of an electroacoustic transducer can include electronic circuitry to perform the functions described herein. In some cases, one or more parts of the apparatus can be provided by a processor specially configured for carrying out the functions described herein. For instance, the processor may include one or more application specific components, or may include programmable logic gates which are configured to carry out the functions describe herein. The circuitry can operate in analog domain, digital domain, or in a mixed signal domain. In some instances, the processor may be configured to carrying out the functions described herein by executing one or more instructions stored on a non-transitory computer medium.

In one example embodiment, any number of electrical circuits described herein may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), computer-readable non-transitory memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In various embodiments, the functionalities described herein may be implemented in emulation form as software or firmware running within one or more configurable (e.g., programmable) elements arranged in a structure that supports these functions. The software or firmware providing the emulation may be provided on non-transitory computer-readable storage medium comprising instructions to allow a processor to carry out those functionalities.

In another example embodiment, the electrical circuits described herein may be implemented as stand-alone modules (e.g., a device with associated components and circuitry configured to perform a specific application or function) or implemented as plug-in modules into application specific hardware of electronic devices. Note that particular embodiments of the present disclosure may be readily included in a system on chip (SOC) package, either in part, or in whole. An SOC represents an IC that integrates components of a computer or other electronic system into a single chip. It may contain digital, analog, mixed-signal, and often radio frequency functions: all of which may be provided on a single chip substrate. Other embodiments may include a multi-chip-module (MCM), with a plurality of separate ICs located within a single electronic package and configured to interact closely with each other through the electronic package. In various other embodiments, the optical sensing functionalities may be implemented in one or more silicon cores in Application Specific Integrated Circuits (ASICs), Field Programmable Gate Arrays (FPGAs), and other semiconductor chips.

It is also imperative to note that all of the specifications, dimensions, and relationships outlined herein (e.g., the number of processors, logic operations, etc.) have only been offered for purposes of example and teaching only. Such information may be varied considerably without departing from the spirit of the present disclosure. The specifications apply only to one non-limiting example and, accordingly, they should be construed as such. In the foregoing description, example embodiments have been described with reference to particular processor and/or component arrangements. Various modifications and changes may be made to such embodiments without departing from the scope of the disclosure. The description and drawings are, accordingly, to be regarded in an illustrative rather than in a restrictive sense.

Note that with the numerous examples provided herein, interaction may be described in terms of two, three, four, or more electrical components. However, this has been done for purposes of clarity and example only. It should be appreciated that the system can be consolidated in any suitable manner. Along similar design alternatives, any of the illustrated components, modules, and elements of the FIGURES may be combined in various possible configurations, all of which are clearly within the broad scope of this Specification. In certain cases, it may be easier to describe one or more of the functionalities of a given set of flows by only referencing a limited number of electrical elements. It should be appreciated that the electrical circuits of the FIGURES and its teachings are readily scalable and can accommodate a large number of components, as well as more complicated/sophisticated arrangements and configurations. Accordingly, the examples provided should not limit the scope or inhibit the broad teachings of the electrical circuits as potentially applied to a myriad of other architectures.

Note that in this Specification, references to various features (e.g., elements, structures, modules, components, steps, operations, characteristics, etc.) included in "one embodiment", "example embodiment", "an embodiment", "another embodiment", "some embodiments", "various embodiments", "other embodiments", "alternative embodiment", and the like are intended to mean that any such features are included in one or more embodiments of the present disclosure, but may or may not necessarily be combined in the same embodiments. Numerous other changes, substitutions, variations, alterations, and modifications may be ascertained to one skilled in the art and it is intended that the present disclosure encompass all such changes, substitutions, variations, alterations, and modifications as falling within the scope of the disclosure. Note that all optional features of the apparatus described above may also be implemented with respect to the method or process described herein and specifics in the examples may be used anywhere in one or more embodiments.

It is also important to note that the functions related to optical sensing of electroacoustic transducers, illustrate only some of the possible functions that may be executed by, or within, suitable electrical systems (e.g., comprising electrical circuitry, processor(s) for processing the optical sensing measurements). Some of these operations may be deleted or removed where appropriate, or these operations may be modified or changed considerably without departing from the scope of the present disclosure. In addition, the timing of these operations may be altered considerably. The preceding operational flows have been offered for purposes of example and discussion. Substantial flexibility is provided by embodiments described herein in that any suitable arrangements, chronologies, configurations, and timing mechanisms may be provided without departing from the teachings of the present disclosure.

What is claimed is:

1. A speaker parameter measurement system for improving performance of a speaker, the speaker parameter measurement system comprising:

a light source to emit light that illuminates a portion of a speaker cone of the speaker;

an angle sensor to measure angle information at which light reflected at the portion of the speaker cone arrives at the angle sensor;

thermo-chromic material applied as a coating for a voice coil of the speaker;

an optical sensor for sensing color of the thermo-chromic material; and a speaker manager to:

derive displacement of the portion of the speaker cone based on the measured angle information, determine temperature of the voice coil based on an output of the optical sensor, and to determine speaker parameters based on the displacement and the temperature, and apply the speaker parameters to drive the speaker and enhance an audio output generated by the speaker.

2. The speaker parameter measurement system of claim 1, wherein:

the speaker manager derives the displacement of the speaker cone based on a right angle geometrical relationship of the displacement and the measured angle information.

3. The speaker parameter measurement system of claim 1, wherein:

the speaker manager derives the displacement of the speaker cone based on tangent of the measured angle information and a distance between the angle sensor and the portion of the speaker cone.

4. The speaker parameter measurement system of claim 1, wherein:

the speaker manager derives the displacement of the speaker cone based on tangent of the measured angle information and a distance between the angle sensor and the light source.

5. The speaker parameter measurement system of claim 4, wherein:

a distance between the angle sensor and the portion of the speaker cone is greater than the displacement of the speaker cone.

6. The speaker parameter measurement system of claim 1, wherein:

the light emitted by the light source is an angled light beam.

7. The speaker parameter measurement system of claim 6, wherein:

the speaker manager calibrates an angle of the angled light beam using the angle sensor.

8. The speaker parameter measurement system of claim 1, wherein:

the angle sensor is coupled to audio input channel via a resistor in series with the angle sensor, wherein the resistor turns an output current of the angle sensor into voltage.

9. The speaker parameter measurement system of claim 1, wherein:

the portion of the speaker cone is adjacent to a surround of the speaker.

10. The speaker parameter measurement system of claim 1, wherein the speaker manager further linearizes, calibrates, and/or protects the speaker based on the speaker parameters.

11. A method for enhancing an audio output generated by an electroacoustic transducer, the method comprising:

driving a light source to emit a light beam towards a portion of the electroacoustic transducer;

receiving a first signal from a first optical sensor measuring light reflected off the portion of the electroacoustic transducer;

receiving a second signal from a second optical sensor sensing color of thermo-chromic material coating on the electroacoustic transducer; and using the first signal and the second signal as feedback control for driving the electroacoustic transducer.

12. The method of claim 11, further comprising:

deriving excursion of the electroacoustic transducer based on the first signal;

wherein the excursion comprises one or more of: position, displacement, velocity, and acceleration.

13. The method of claim 11, wherein the first signal provides voltage and/or current driven feedback to control electroacoustic transducer parameters for linearization and protection control.

14. The method of claim 11, wherein using the first signal and the second signal as feedback control comprises:

controlling an adaptive filter based on the first signal, wherein the adaptive filter filters an audio signal to the electroacoustic transducer.

15. The method of claim 11, wherein using the first signal and the second signal as feedback control comprises:

executing real-time diagnostics within electroacoustic speaker assembly based on the first signal and the second signal.

16. The method of claim 11, wherein using the first signal and the second signal as feedback control comprises:

determining, based on the first signal, one or more of the following: rub and buss, voice coils misalignment, and DC offset during a lifetime of the electroacoustic transducer.

17. The method of claim 11, wherein using the first signal and the second signal as feedback control comprises:

verifying rest position of a voice coil of the electroacoustic transducer based on the first signal.

18. A system, comprising:

a speaker assembly comprising a speaker cone, a dust cap, a voice coil, and a center pole;

a first optical sensor placed on the center pole for measuring an amount of light reflected off a dust cap;

a second optical sensor for sensing color of thermo-chromic material coating on the voice coil;

means for deriving displacement based on a first signal from the first optical sensor and the amount of light varying as a function of displacement of the dust cap;

means for deriving temperature based on a second signal from the second optical sensor; and digital signal processing means controlling the speaker assembly based on the displacement and the temperature to improve an audio output of the speaker assembly.

19. The system of claim 18, wherein the digital signal processing means comprises:

means for executing speaker protection mechanism based on the displacement and the temperature.

20. The system of claim 18, wherein the digital signal processing means comprises:

means for executing real-time diagnostics on the speaker assembly based on the displacement and the temperature.

* * * * *